US006161796A

United States Patent [19]

Daniels

[11] Patent Number: 6,161,796

[45] Date of Patent: Dec. 19, 2000

[54] PAPER TOWEL ROLL DISPENSER

[76] Inventor: Darlene Daniels, 250 Newbury La., Newbury Park, Calif. 91320

[21] Appl. No.: 09/378,937

[22] Filed: Aug. 23, 1999

[51] Int. Cl.[7] ..... B65H 18/04; B65H 49/26

[52] U.S. Cl. ..... 242/597.7; 242/597.1; 242/597.4; 242/597.8; 242/598.5

[58] Field of Search ..... 242/597.7, 597.1, 242/597.4, 597.8, 598.5, 598.3, 588.6, 596.8; D6/522

[56] References Cited

U.S. PATENT DOCUMENTS

| | | | |
|---|---|---|---|
| D. 326,203 | 5/1992 | Butler | D6/522 |
| 2,475,882 | 7/1949 | De Capite | 242/598.5 |
| 3,087,608 | 4/1963 | Craven | 242/588.6 |
| 3,413,049 | 11/1968 | Smay | 312/39 |
| 3,492,056 | 1/1970 | Murray | 312/242 |
| 3,698,548 | 10/1972 | Stenzel et al. | 242/588.6 X |
| 3,865,323 | 2/1975 | Stronge et al. | 242/588.6 |
| 4,272,035 | 6/1981 | Sherman et al. | 242/596.8 X |
| 4,369,929 | 1/1983 | Cayer | 262/596.8 X |
| 4,936,452 | 6/1990 | Pauley | 242/588.6 |
| 5,038,934 | 8/1991 | Higashiyama | 206/454 |
| 5,598,987 | 2/1997 | Wachowicz | 242/597.8 |
| 5,763,984 | 6/1998 | Day | 312/34.8 |
| 5,868,346 | 2/1999 | Cobos | 242/593 |
| 5,941,476 | 8/1999 | Copass | 262/588.6 |

*Primary Examiner*—Donald P. Walsh
*Assistant Examiner*—William A. Rivera
*Attorney, Agent, or Firm*—Jack C. Munro

[57] ABSTRACT

A paper towel roll dispenser has an enclosing polygonal shaped housing within which is mounted an access door which is movable from a closed position to an open position. To be mounted within the internal chamber of the housing is a post assembly which is comprised of an elongated post fixedly mounted onto a polygonal shaped base. The base and post are to be mounted within the internal chamber of the housing with the polygonal shaped base interlockingly connect with the housing in a non-rotative manner. A roll of paper towels is to be mounted in conjunction with the post with the free end of the roll of paper towels to be inserted through a slot in the housing and extend exteriorly of the housing. There is a first version of this invention that is adapted to be stood on end and a second version that is adapted to be mounted under a shelf.

5 Claims, 4 Drawing Sheets

PAPER TOWEL ROLL DISPENSER

BACKGROUND OF THE INVENTION

1) Field of the Invention

The field of this invention relates to a dispenser for a roll of paper towels and more particularly to a dispenser which can be utilized by standing on end on a shelf or a counter or a dispenser that can be mounted under a shelf.

2) Description of the Prior Art

Dispensers for rolls of paper towels have long been known. A common form of such a dispenser is a device which can be mounted underneath a shelf which has a pair of opposed, depending brackets with these brackets being used to connect to the hollow core of a roll of paper towels and rotationally mount the roll of paper towels between the brackets. Dispensing of the towels is accomplished by manually unwinding of the paper towels relative to the brackets.

One of the big disadvantages of the prior art type of dispenser is that the entire roll of paper towels is exposed and therefore is not particularly attractive in appearance. In the past, it has been known to construct dispensers of different types that function to hide the roll of paper towels. However, these dispensers of the prior art have been constructed to be complex and therefore inherently expensive to manufacture thereby being relatively costly to the consumer. In the past if an effort has been made to construct a dispenser to be less costly, it gives the appearance of being "cheap".

There is a need to construct a paper towel roll dispenser which gives the appearance of being a rather expensive product yet, in reality, is reasonable in cost. There is also a need to construct a paper towel roll dispenser that facilitates the dispensing of the paper towels and also facilitates replacement of a paper towel roll.

SUMMARY OF THE INVENTION

The paper towel roll dispenser of the present invention is constructed to include a enclosing housing which includes an access door to provide access into the internal chamber of the housing. The housing in transverse cross-section is polygonal shaped. A post assembly, which includes an elongated post fixedly mounted onto a base, is to be insertable within the internal chamber of the housing with the base interlockingly fitting with the polygonal shape of the housing. The access door may have a longitudinal slot through which is to extend the free end of the roll of paper towels that is mounted on the post and is contained within the internal chamber. There is a first version of the invention which is to comprise a stand-up version which is to stand on one end and is to rest on any shelf or counter. There is a second version of the invention which is to be horizontally mounted under a shelf. Within the second version of the invention, the outer end of the elongated post is to have removably mounted thereon a lid with this lid being identical to the base to which the elongated post is fixedly mounted.

One of the primary objectives of the present invention is to construct a paper towel roll dispenser which supports a roll of paper towels in a convenient manner and facilitates dispensing of such with the dispensing either occurring in a vertical manner or a horizontal manner.

Another objective of the present invention is to construct a paper towel roll dispenser which provides for easy replacement of spent paper towel rolls.

Another objective of the present invention is to construct a paper towel roll dispenser constructed of few parts with each part being constructed to facilitate manufacturing.

Another objective of the present invention is to construct a paper towel roll dispenser that can be operated even by the most unskilled individual.

DETAILED DESCRIPTION OF THE PREFERRED EMBODIMENT

Figure 1:
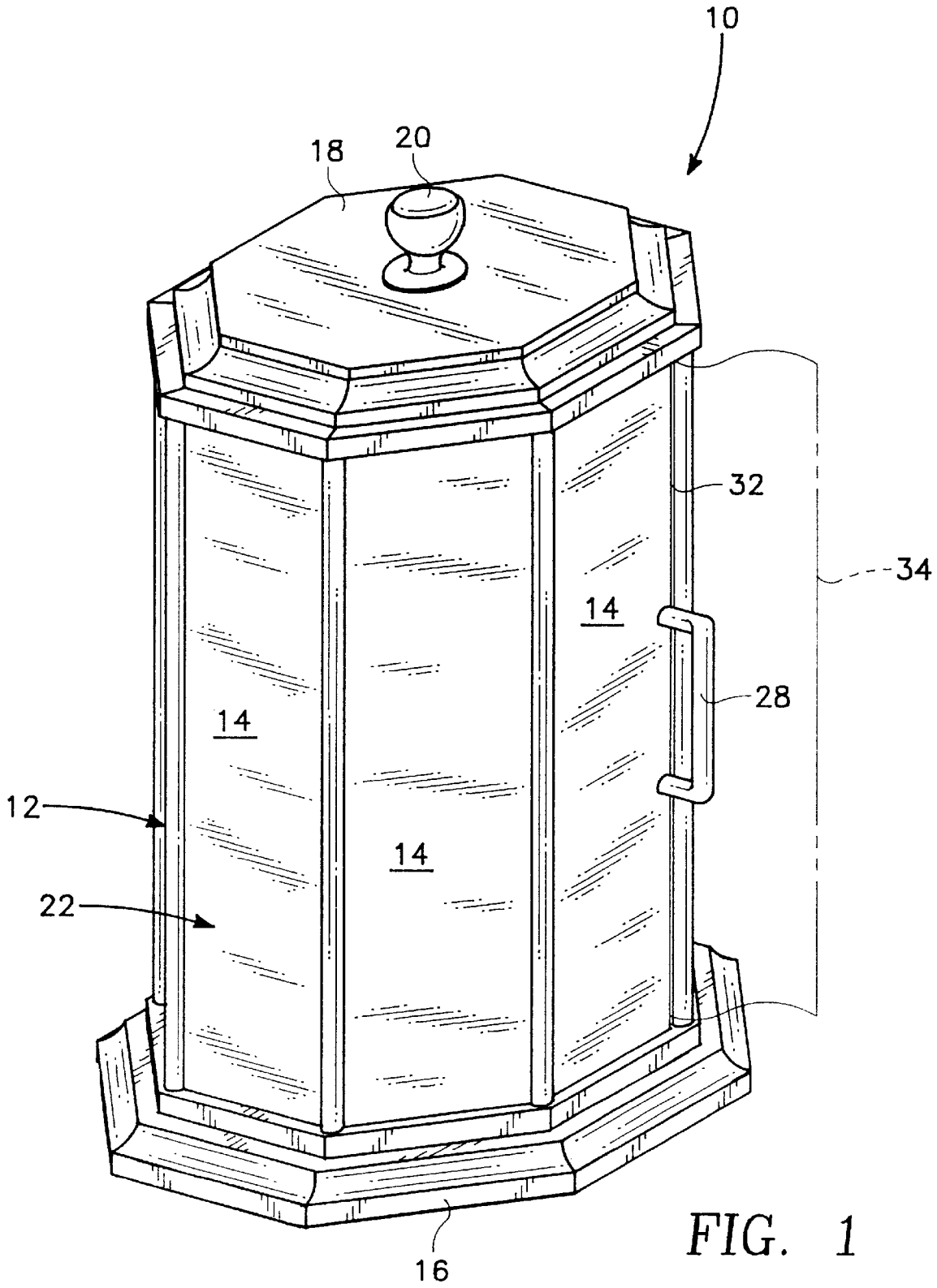
FIG. 1 is an exterior isometric view of the stand-up version of the paper towel roll dispenser of the present invention showing the dispenser in the normal dispensing position.
Figure 2:
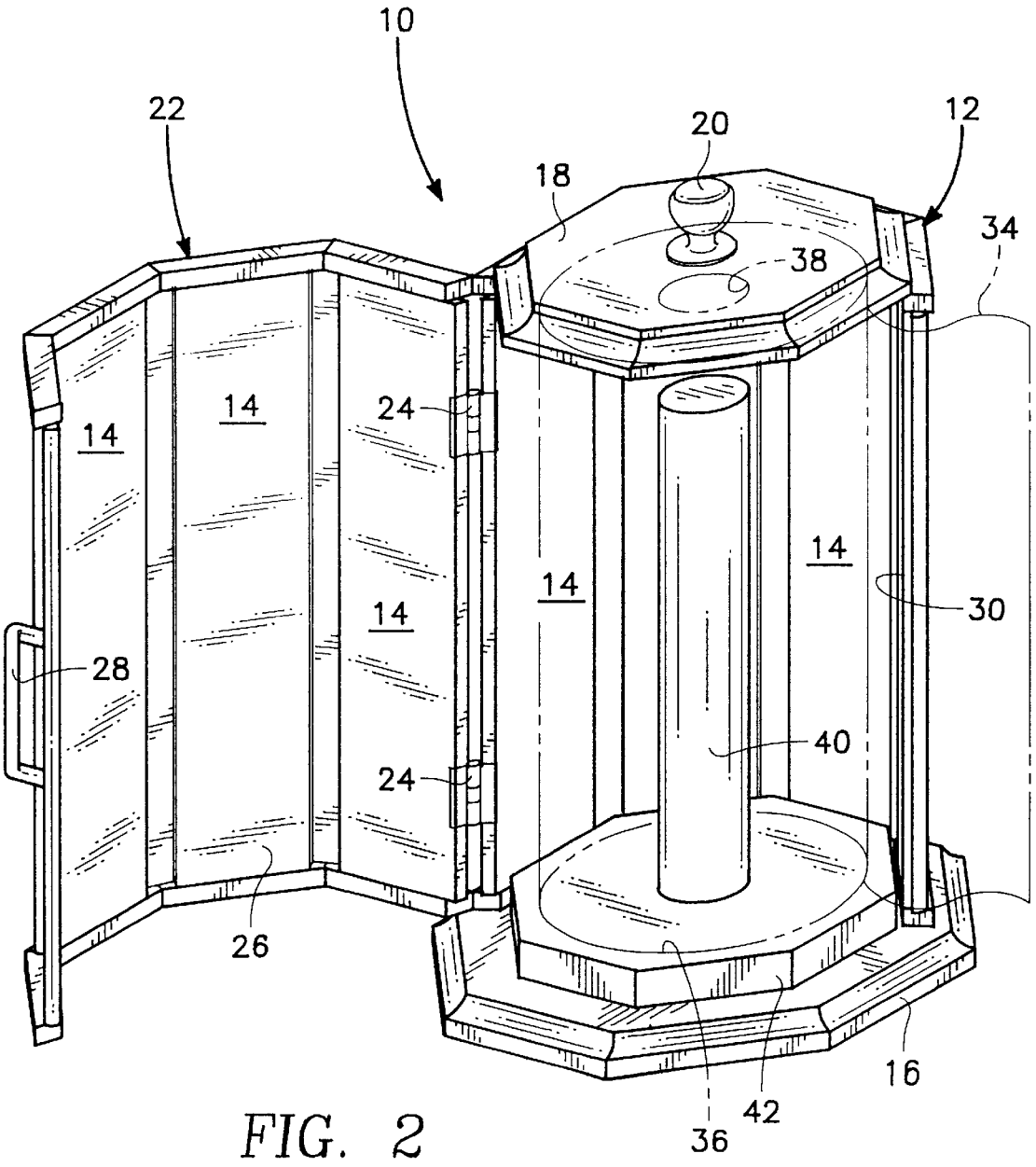
FIG. 2 is an isometric view of the stand-up version of the paper towel roll dispenser of the present invention showing the access door of the dispenser open showing the interior of the dispenser housing.

Referring particularly to FIGS. 1 and 2 of the drawings, there is shown the stand-up version 10 of paper towel roll dispenser of the present invention. The stand-up version 10 has a housing 12 which is constructed of a plurality of thin planar panels 14 arranged in a general arcuate configuration with this arcuate configuration defining one-half of an octagon. The panels 14 are fixedly secured at their respective ends to a bottom plate 16 and a top plate 18. Mounted on the top plate 18 is a handle 20. The handle 20 is to be used for the purpose of manually moving of the stand-up version 10 from one location to another with it being understood that the bottom plate 16 is to rest on a planar supporting surface which is a shelf or a counter.

The housing 12 includes an access door 22 which is hingedly connected by hinges 24 to one of the panels 14. The access door 22 is constructed of four in number of panels 26 which are joined at their edges to form the remaining half of an octagon. On the exterior surface of the access door 22 is mounted a handle 28. The access door 22 can be pivotally moved from the closed position shown in FIG. 1 by grasping of the handle 28 and pulling outwardly to the open position shown in FIG. 2. This open position, shown in FIG. 2, will provide access into the internal chamber 30 of the housing 12. When the access door 22 is in the closed position shown in FIG. 1, there is a slight gap forming a slot 32 between the access door 22 and one of the panels 14. The slot 32 is located at the free outer edge of the access door 22. Through this slot 32 is to be conducted the free outer end 34 of a paper roll 36 which is to be located within the internal chamber 30. This paper roll 36 is to have a hollow core 38. Within the hollow core 38 is to be mounted an elongated post 40. The elongated post 40 is fixedly mounted on one end thereof to a base 42. The base 42 has an exterior peripheral, octagonal shaped surface which is of a size that closely conforms in an interlocking manner to the octagonal configuration of the internal chamber 30. It is to be understood that the base 42, post 40 and roll 36 is to be disengageable from the internal chamber 30 mainly for the purpose of replacing a spent roll 36 at which time the base 42, post 40 and a new roll 36 will be reinserted within the internal chamber 30. The free outer end 34 of the roll 36 is then extended through the slot 32 and the access door 22 is then moved to the closed position, as shown in FIG. 1. At this time, the stand-up version 10 is in its normal usage dispensing position.

Figure 3:
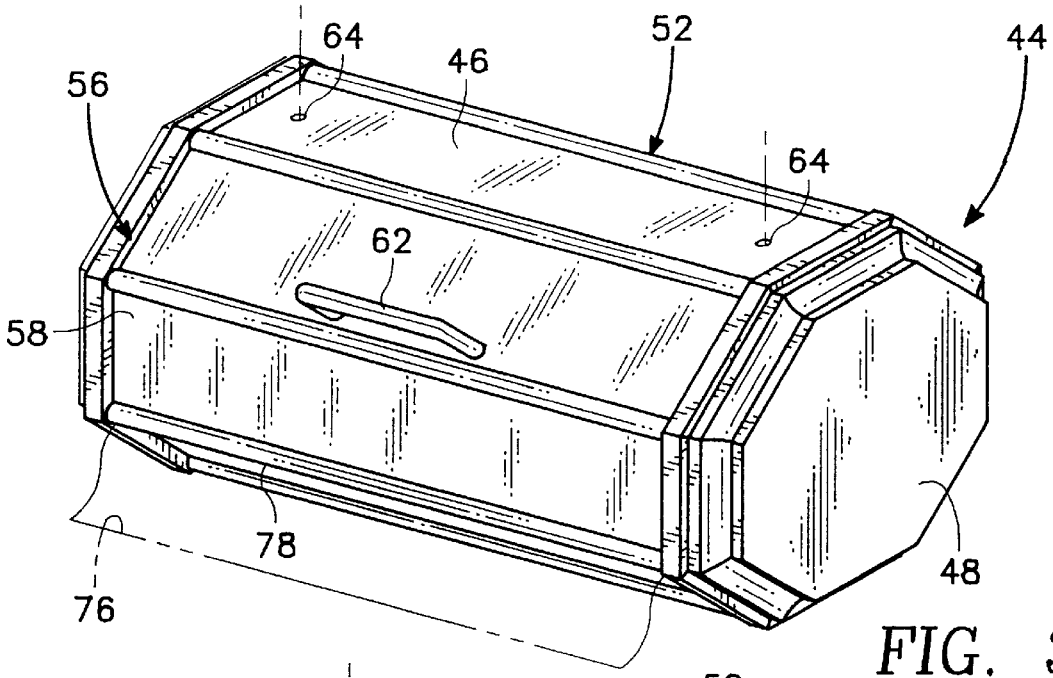
FIG. 3 is an isometric view of the under-the-shelf version of paper towel roll dispenser of the present invention showing the dispenser in the closed position, which would be the normal dispensing position.
Figure 4:
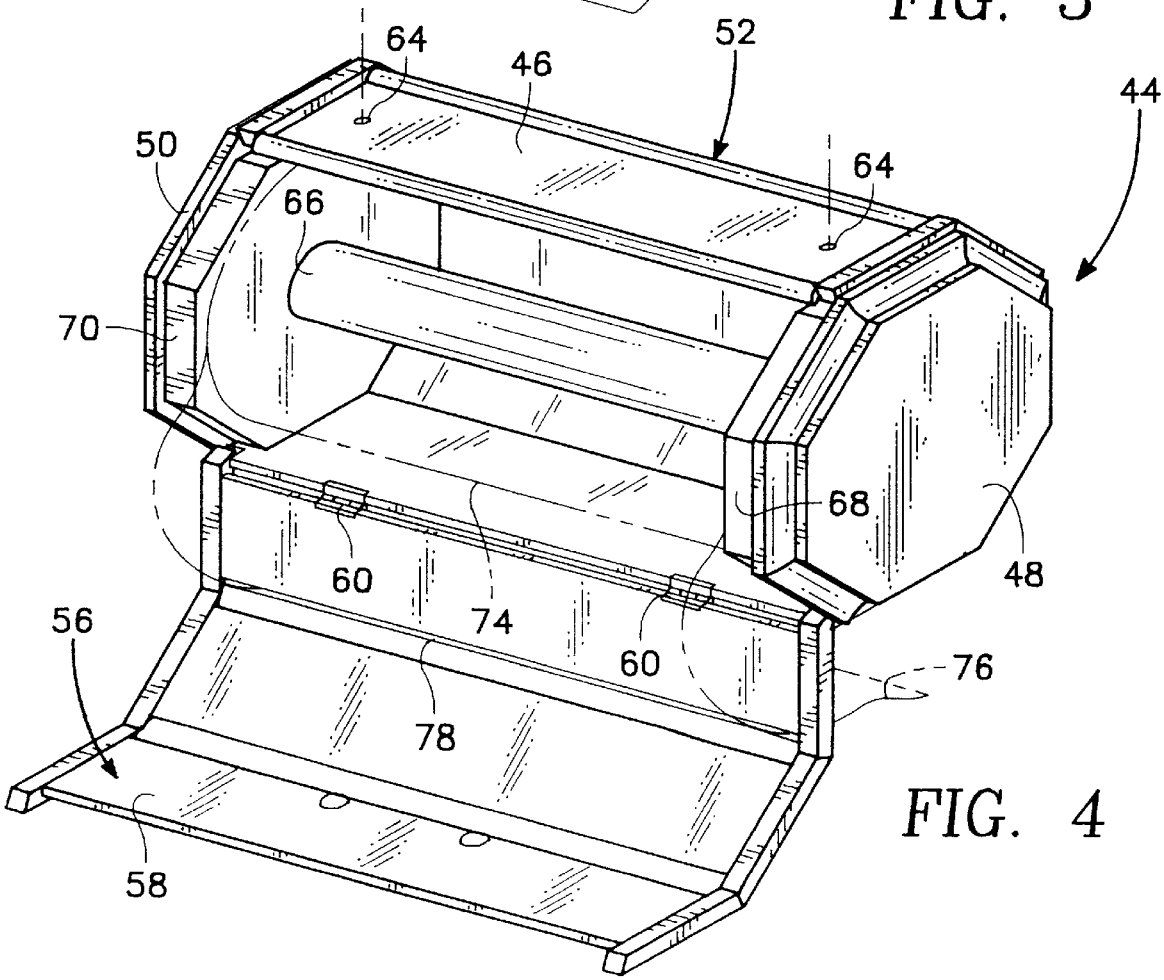
FIG. 4 is an isometric view of the under-the-shelf version of paper towel roll dispenser of the present invention with the access door being shown in the open position clearly depicting the interior of the housing within which the roll of paper towels is to be mounted.
Figure 5:
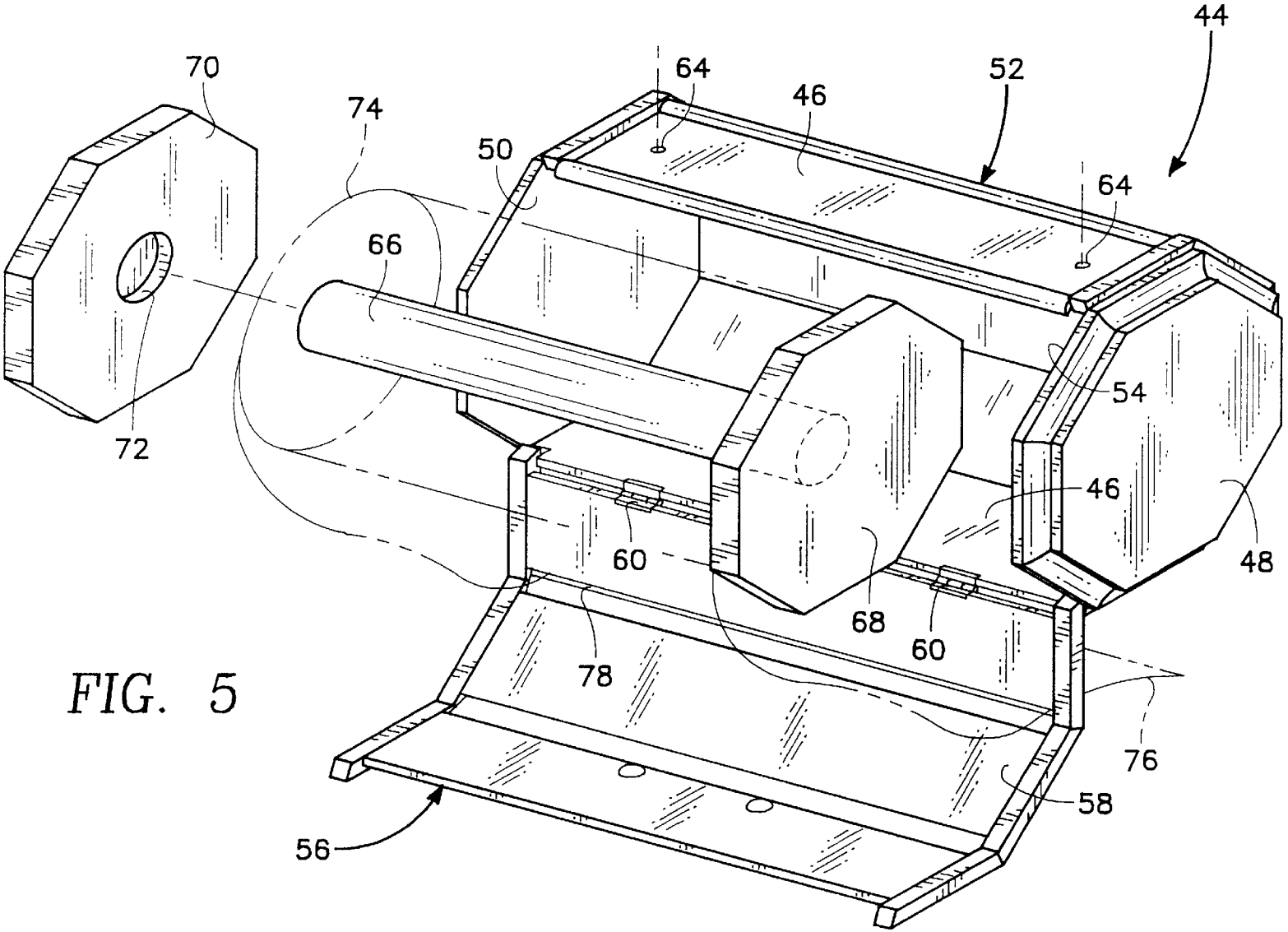
FIG. 5 is an exploded isometric view of the under-the-shelf version of paper towel roll dispenser of the present invention.

Referring particularly to FIGS. 3 to 5 of the drawings, there is shown the under-the-shelf version 44 of the paper towel roll dispenser of this invention. The version 44 has five in number of planar panels 46 which are connected together forming five-eights of an octagonal configuration. The ends of the panels 46 are fixedly secured to a right end plate 48 with the opposite end of the panels 46 being fixedly secured to a left end plate 50. The panels 46 and end plates 48 and 50 form the housing 52. Within the housing 52 there is defined an internal chamber 54.

The internal chamber 54 can be closed to the ambient by means of an access door 56. The access door 56 is constructed of a plurality of interconnected planar panels 58 with there being three in number of panels 58. The access door 58 is pivotally mounted by hinges 60 to one of the panels 46. Fixedly mounted on the exterior surface of the access door 56 is a handle 62. Pulling movement on the handle 62 will cause the access door 56 to move from the closed position shown in FIG. 3 to the open position shown in FIG. 4. Mounted within one of the panels 46 are a pair of spaced apart holes 64 which are to be used to connect with fasteners (not shown), such as screws or bolts, to secure the housing 52 underneath a shelf, which is not shown. This type of securement will locate the housing 52 horizontal rather than the vertical disposition of the housing 12.

Locatable within the internal chamber 54 is a post assembly that is composed of an elongated post 66, a base 68 and is a lid 70. The post 66 is cylindrical. One end of the post 66 is fixedly secured and centrally disposed on the base 68. The lid 70 has a center recess 72 with the post 66 being capable of removingly connecting with the center recess 72. The lid 70 is essentially identical to the base 68 with each having a polygonal configuration which is actually octagonal. The size of the octagonal configuration of both the base 68 and the lid 70 is such that the base 68 and lid 70 are capable of interlocking within the internal chamber 54. This will prevent rotation of the post 66, base 68 and lid 70 relative to the housing 52. A paper towel roll 74 is to be mounted on the post 66 with the outer free end 76 of the roll 74 extending through a slot 78 formed within the access door 56. In order to replace a spent roll 74, it is only necessary to remove the post assembly composed of base 68, post 66 and lid 70 from the internal chamber 54 then disconnect the lid 72 from the post 66 which will then permit remounting of a separate roll 74 onto the post 66. The lid 72 is then to be replaced and the entire post assembly then reinserted within the internal chamber 54. The access door 56 is then closed after the outer free end 76 of the paper towel roll 74 has been conducted through the slot 78. This means that the outer free end 76 will extend exteriorly of the under-the-shelf version 44 and can we unwound from the roll 74 and torn off at the desired location to achieve the desired length of paper towel.

The primary reason for having the base 42 and the base 68 and lid 70 to interlock in conjunction with their respective internal chambers 30 and 54 is so that only the roll 36 and 74 will rotate within their respective internal chambers 30 and 54. Therefore, the dispensing of the paper towels is accomplished essentially noiseless, which is a desirable feature.

What is claimed is:

1. A paper towel roll dispenser comprising:

a housing having an internal chamber formed within a fixed section, said internal chamber in transverse cross section having a first polygonal shape, an access door included within said housing, said access door being pivotable between a closed position and an open position relative to said fixed section, with said access door in said closed position there is an elongated slot formed between said access door and said fixed section, said closed position completely enclosing said internal chamber, said open position permitting access into said internal chamber;

a post assembly comprised of an elongated post fixedly mounted onto a base, said base having a peripheral edge, said peripheral edge having a second polygonal shape, said base is capable of interlockingly fitting within said internal chamber by said first polygonal shape connecting with said second polygonal shape with said post being centrally disposed and extending longitudinally within said internal chamber; and whereby a roll of paper towels which has a hollow core is to be mounted on said post with said post located within the hollow core, whereby the roll of paper towels and post assembly is to be inserted into said internal chamber with said base to interlock with said housing to not be capable of rotation relative to said housing, whereby a free end of the roll of paper towels is to be passed through said elongated slot and then said access door is located in said closed position with dispensing of the paper towels occurring by pulling on the free end and tearing off of a desired length of towel.

2. The paper towel roll dispenser as defined in claim 1 wherein:

a graspable handle being mounted on said access door, said graspable handle to facilitate movement of said access door between said closed position and said open position.

3. The paper towel roll dispenser as defined in claim 2 wherein:

both said first polygonal shape and said second polygonal shape being octagonal.

4. The paper towel roll dispenser as defined in claim 3 wherein:

said housing having a base end, said base being in contact with said base end when said post assembly is mounted within said internal chamber, said base end being adapted to rest on a planar supporting surface during the dispensing of a towel.

5. The paper towel roll dispenser as defined in claim 1 wherein:

said elongated post having a lid mounted thereon, said lid adapted to being removably mounted on said post with the disengagement of said lid from said post being required in order to mount a roll of paper towels in conjunction with said elongated post, said lid being essentially identical in configuration to said base with said lid also to interlockingly fit within said internal chamber when said post assembly is mounted within said internal chamber, whereby the version of said paper towel dispenser that includes said lid is adapted to be mounted under a shelf and thereby located horizontally.

* * * * *